United States Patent [19]

Paffhausen et al.

[11] Patent Number: 4,801,215

[45] Date of Patent: Jan. 31, 1989

[54] RAMP RIBBON CARTRIDGE

[75] Inventors: Hans Paffhausen; Uli G. Morf, both of Franklin, Tenn.

[73] Assignee: Pelikan, Inc., Franklin, Tenn.

[21] Appl. No.: 55,011

[22] Filed: May 28, 1987

[51] Int. Cl.[4] ..... B41J 32/00

[52] U.S. Cl. ..... 400/224; 400/208

[58] Field of Search ..... 400/208, 224

[56] References Cited

U.S. PATENT DOCUMENTS

| | | | |
|---|---|---|---|
| 4,209,261 | 6/1980 | Bell et al. | 400/621 |
| 4,257,282 | 3/1981 | Wilczewski et al. | 400/224 |
| 4,325,645 | 4/1982 | Miyajima et al. | 400/196.1 |
| 4,350,451 | 9/1982 | Furrow | 400/224 |
| 4,415,285 | 11/1983 | Bury | 400/238 |
| 4,493,572 | 1/1985 | Van Ocker et al. | 400/224 |

FOREIGN PATENT DOCUMENTS

| | | | |
|---|---|---|---|
| 175010 | 3/1986 | European Pat. Off. | 400/224 |
| 59488 | 4/1984 | Japan | 400/224 |
| 169880 | 9/1984 | Japan | 400/224 |

*Primary Examiner*—William Pieprz

*Attorney, Agent, or Firm*—John F. A. Earley; John F. A. Earley, III; P. Michael Walker

[57] ABSTRACT

A ramp ribbon cartridge adapted for ramp mounting of a ribbon in a printer device which comprises a cartridge housing having a first end and a second end, a ribbon stored in and extending from the cartridge housing and on which a printing head makes a printing track while printing, a drive wheel for pulling the ribbon out of the housing, with the drive wheel being rotatably mounted at a first end of the cartridge housing and being adapted to connect with a drive shaft in a printer device, a ramping mechanism between the cartridge housing and positioned near the second end of the housing so as to place the ribbon at a ramp angle to the horizontal, a loose fitting connection between the drive wheel and the drive shaft of the printer device so that the drive shaft still drives the drive wheel without binding when the drive wheel is tilted on its axis away from the vertical, whereby the printing track of the ribbon is at a ramp angle to the top and bottom edges of the ribbon and is wider than if the ribbon were positioned in a horizontal attitude.

7 Claims, 3 Drawing Sheets

RAMP RIBBON CARTRIDGE

BACKGROUND OF THE INVENTION

1. Field of the Invention

This invention relates to office printers, and more particularly concerns improvements in ribbon cartridges, especially film ribbon cartridges, and attachments therefor.

2. Description of the Prior Art

In the prior art, ribbons made of nylon have been used in office printers and have proven to be long lasting. Both sides of the ribbon may be used. Also, the nylon ribbons may be re-inked and re-used. It is comparatively new to have film ribbon stuffed in a fan-folded manner in a cartridge, like nylon ribbon has been stuffed for a number of years.

In the prior art, film ribbons have produced a better printing image than that produced by the nylon ribbons, and have been cleaner to handle since they are inked on only one side. But they have had a shorter life than nylon ribbons, with a typical film ribbon having only 20% to 30% of the life of a nylon ribbon.

A ribbon cartridge includes a plastic case and cover, a ribbon folded in the body of the case and cover, drive means for advancing the ribbon outside the case and cover, and springs to apply tension to the ribbon. The ribbon cartridge is placed in a printer and is used in common EDP (Electronic Data Processing) applications.

The printer advances the drive means located in the cartridge body, and a guide system around the printer head guides the inked ribbon to place it in position for printing.

In general, there are two different types of inked ribbons in a ribbon cartridge, nylon ribbon and film ribbon.

In the nylon ribbon, the substrate is impregnated with a special ink formulated for impact printing, and the nylon ribbon with its fibers build up an ink reservoir, and provides ink in front of the printer head in a consistent manner. The nylon ribbon is folded in an organized fashion in a stuffing box in the ribbon cartridge so that it pulls out smoothly and evenly.

It is common in nylon cartridges to twist the ribbon by 180 degrees. This twisting is called a "Moebius-loop", and the advantage of this configuration is to achieve a higher use of the ribbon by using more of it. The printing track may be on both the top edge portion of the ribbon and on the bottom edge portion of the ribbon. It can improve the print life of the nylon ribbon cartridge up to about 90% over the cartridge wherein the ribbon is not twisted by 180 degrees.

On the other hand, a film ribbon consists of a base material, which may be Mylar film, and a coating which may be a black solvent ink coating. The coating is applied to only one side of the film, and is placed so that it faces the paper when installed in front of a printer head. The film is stored in a stuffing box in the cartridge and is folded in the same way as a regular nylon ribbon, but it cannot be twisted by 180 degrees. The "Moebius" system cannot be used because the film ribbon is coated on only one side. The film cannot be coated on two sides because of the abrasiveness of the coating and because of surface conditions. Therefore, the life of a film ribbon cartridge is significantly lower than the life of a nylon ribbon cartridge using the "Moebius-loop".

It is an object of this invention to increase the life of film ribbons to make it closer to the life of nylon ribbons.

SUMMARY OF THE INVENTION

In order to give longer life to film ribbons, we invented a ribbon cartridge that produces a ribbon that has a ramping effect. This ramp ribbon cartridge is mounted on the carriage in the printer at an angle to the horizontal. The printer head runs horizontally as does the carrier of the printer, but the print track is at a ramp angle to the top and bottom edges of the ribbon, and the print track is larger or wider than it would be had the tape been positioned in a horizontal attitude. This ramping effect is produced by providing a riser clip or button which is positioned underneath the housing of the cartridge at the end way from the driving wheel end of the cartridge.

This ramping effect is already known in printers to achieve extended life from the ribbon in a ribbon cartridge, but the ramping mechanism was built into the printer itself, the hardware. In our invention, the ramping effect is achieved by using the ribbon cartridge which is independent of the printer hardware. It has the advantage of being able to convert any horizontal, non-ramping hardware into a printer that produces a ramping ribbon.

DETAILED DESCRIPTION

Figure 1:
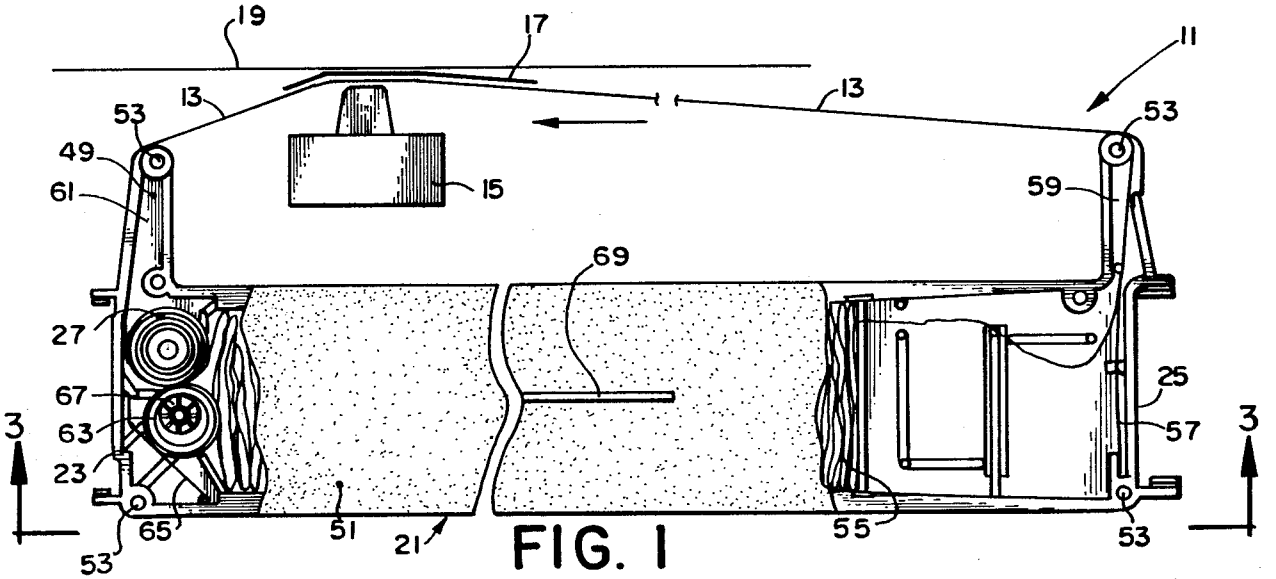
FIG. 1 is a view in top plan of a ramp ribbon cartridge constructed in accordance with this invention and has parts cut-away to show elements of the cartridge.

Turning now to the drawings, there is shown a ramp ribbon cartridge or cassette 11 which is adapted for ramp mounting of a film ribbon 13 in a printer or printer device having a printing head 15, a mask 17, and is adapted to print onto a sheet of paper 19.

Cartridge 11 includes a housing 21 which has a first or drive end 23 and a second or exit end 25. Ribbon 13 is stored in housing 21 and extends from the housing 21. Printing head 15 makes a track on ribbon 13 while the printing head is printing onto sheet of paper 19.

A drive wheel 27 having exterior teeth is provided for pulling the ribbon out of housing 21. Drive wheel 27 is rotatably mounted at the first end portion 23 of the cartridge housing 21 and is adapted to seat on or connect with a drive shaft in a printer device. The connection between the drive wheel 27 and the drive shaft of the printer device is a loose fit so that the drive shaft still drives the drive wheel 27 without binding even when the drive wheel is tilted.

Figure 4:
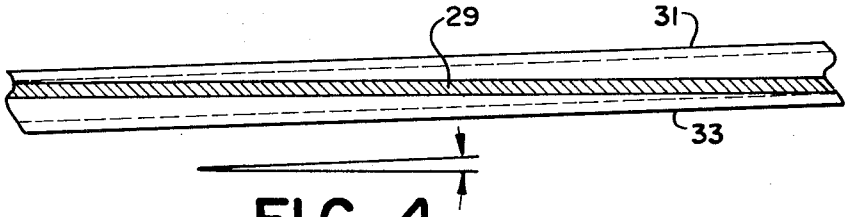
FIG. 4 is a view in elevation of the ramped ribbon showing a wide print track and showing a ramp angle of about ten degrees.

A ramping mechanism is provided beneath the cartridge housing 21 and is positioned away from the drive wheel end 23 of the housing 21 in order to elevate the second end 25 of housing 21 and to position the ribbon 13 at a ramp angle to the horizontal as shown in FIG. 4.

Accordingly, the printing track 29 of the ribbon 13 is at a ramp angle to the top edge 31 and bottom edge 33 of the ribbon 13 and is wider than if the ribbon 13 were positioned in a horizontal attitude. The ramp angle in FIG. 4 is shown as being ten degrees. The ramp angle may be varied, just so long as the printing track 29 does not run off the ribbon. Accordingly, the wider the cartridge 11 is, the distance between its first end 23 and its second end 25, the smaller the ramp angle may be. With a shorter ribbon cartridge, the ramp angle may be larger and still the printing track does not run off of the ribbon.

Figure 5:
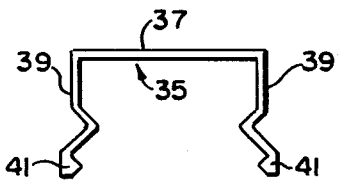
FIG. 5 is a view in side elevation of a riser clip forming a part of this invention.

A preferred ramping mechanism is shown more particularly in FIG. 5 which illustrates a riser clip 35 made of a resilient synthetic plastic material that snaps into housing 21. Riser clip 35 is U-shaped and includes a base 37 and a pair of legs 39 extending therefrom, with the bottom portion 41 of the legs 39 extending beneath the housing 21 so that when the cartridge 11 is placed on a horizontal carrier 43 of a printing device, the cartridge 11 and the ribbon 13 are placed in a ramp position. The riser clip 35 is connected to housing 21 by an ultrasonic weld 45 between the clip base 37 and the housing.

Figure 6:
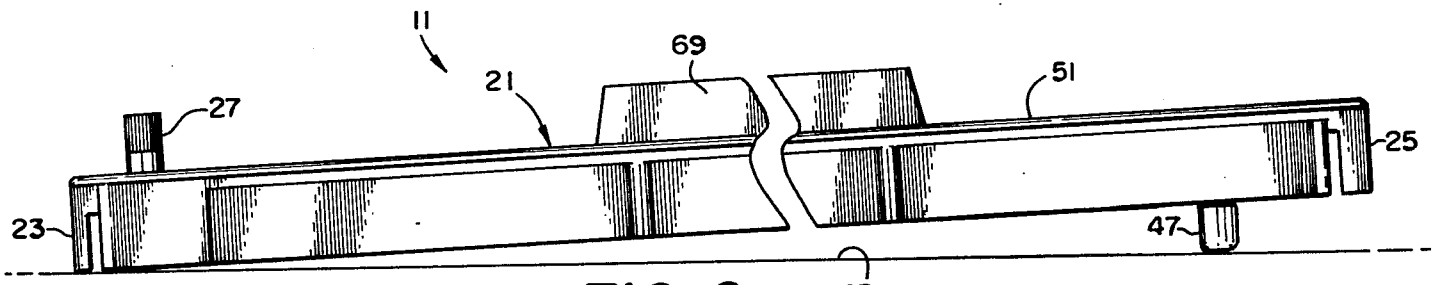
FIG. 6 is an elevation view of an alternative embodiment of the invention showing a different ramp mechanism.

In an alternative embodiment of the invention as shown in FIG. 6, the ramping mechanism may comprise a resilient button 47 mounted on the bottom of the housing at the second end portion 25.

Housing 21 includes a cartridge case 49 and a cartridge cover 51 which is attached to case 49 by a number of depending pins that are press-fitted into socket holes 53 in the case 49.

Ribbon 13 is folded and stored in stuffing box 55 in cartridge case 49, and is pulled out of stuffing box 55 to pass by a number of ribbon guides and brake spring 57 to emerge from housing 21 and housing arm 59 through a slot in arm 59. The ribbon then passes between printer head 15 and mask 17 and returns to housing 21 through a slot in housing arm 61 where it passes between drive wheel 27 and planetary gear or press wheel 63, both of which are provided with exterior teeth. A press or pinch spring 65 and a pinch roller 67 press against planetary gear 63 to hold it resiliently against drive wheel 27 with the ribbon 13 therebetween. This arrangement allows for passing the ribbon splice, which may be thicker than the ribbon itself, between the drive wheel 27 and the planetary gear 63 without binding and without causing the ribbon drive mechanism to jam.

Figure 7:
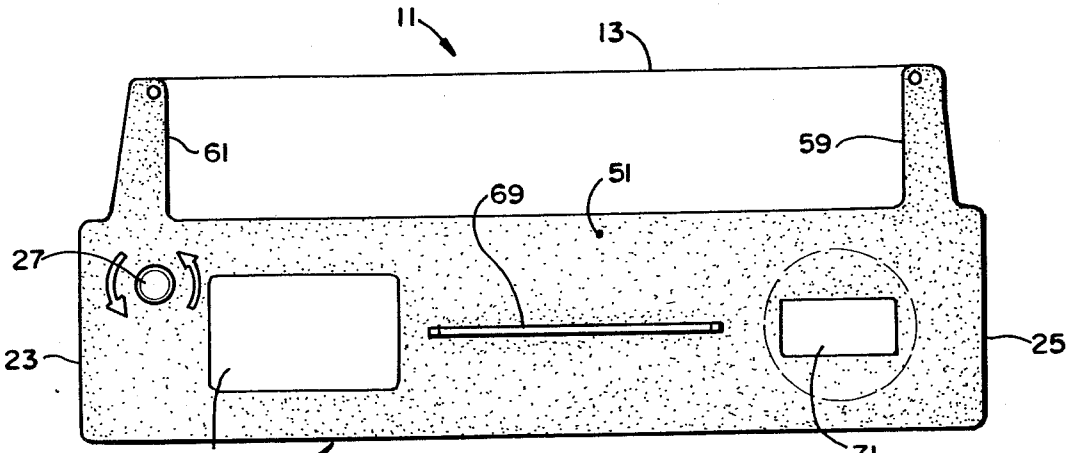
FIG. 7 is a view in top plan showing the cover of the ribbon cartridge housing.

Referring to FIG. 7, which shows the top plan view of cover 51, the cover 51 includes a grasping fin 69 which is used to hold the cartridge when it is being inserted into the printer, and to position it properly in the printing device. Cover 51 also includes a rectangular blank surface 71 for attaching a label showing a trademark or a logo, and a blank rectangular portion 73 which may be used for embossing thereon installation instructions.

Figure 2:
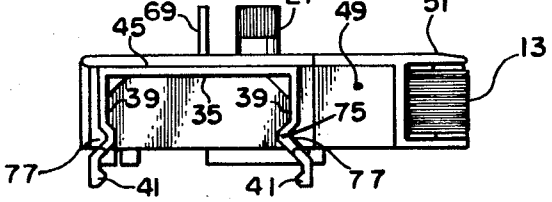
FIG. 2 is a view in elevation of the right side of the ribbon cartridge of FIG. 1.
Figure 3:
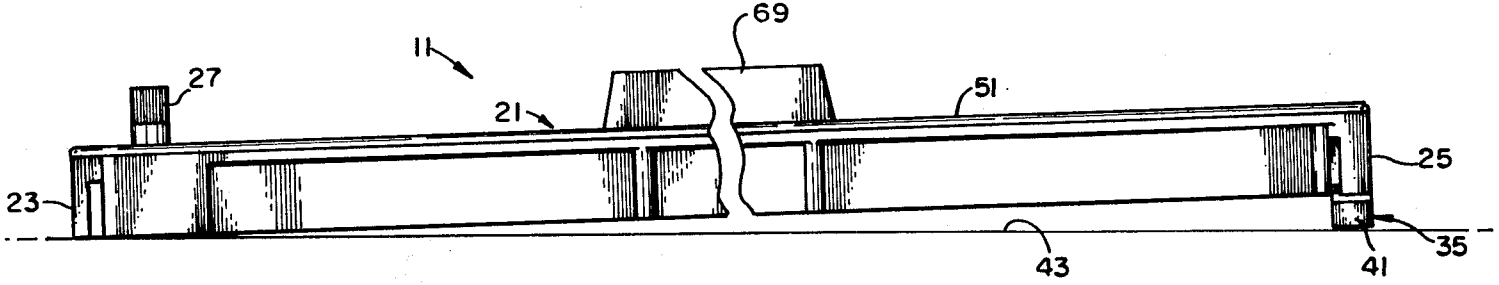
FIG. 3 is a view in elevation of the rear wall of the housing of FIG. 1 showing the ramping with respect to the carrier of a printer and is taken as indicated by the lines and arrows 3—3 which appear in FIG. 1.

As may be seen from FIG. 2, riser clip 35 is provided with a bend 75 in each leg 39, and bend 75 snaps over a boss 77 in housing 21.

In operation, the ramp ribbon cartridge 11 is inserted into a printer and seated on the horizontal carriage or carrier 43 of the printer to place the cartridge 11 and the ribbon 13 in a ramp position so that when the printer is being used, it forms a printing track which is at an angle from the edges 31, 33 of the ribbon 13 and is a wider track than that which would have been produced had the cartridge 11 and ribbon 13 not been ramped. This extends the life of the ribbon 13 substantially.

ADVANTAGES

Dot Matrix Film (DMF) ribbons have a number of features and advantages over the regular nylon ribbons.

For example, with DMF ribbons the printer head needles never touch the ink, only the film, and this produces a longer life for the printer head, and assures that the print head is kept clean.

DMF ribbons are able to use a heavier pigment of ink with a uniform coating, so as to be more lightfast than nylon ribbon, with no "hot spotting". The consistently darker printout copies better and enables scanners to pick up characters better.

Film ribbon is thinner than nylon fabric ribbon, approximately one quarter of the regular nylon thickness, and the thinner the ribbon the cleaner and sharper the print image.

With film ribbon there is no "feathering" of ink, which gives a sharper printout that is excellent for bar coating and gives better quality printouts.

Film ribbons are inked only on one side which keeps the hands clean when changing ribbons, and also keeps the printer cleaner. No smudge appears on the cartridge during use and in the manufacturing process.

The ink in film ribbons is of low viscosity, so that if the ribbon accidentally touches the paper in the printer, the ink does not wick into the paper like it does at times with inked nylon fabric ribbons.

The ink on film ribbons is non-carcinogenic, and produces non-toxic printouts that are good for labels on food, etc.

The ink on film ribbons may have more dye in it than the color material in nylon fabric ribbons, and thus produces more brilliant colors and much higher yield.

Film ribbons are spliced to make a continuous loop, whereas nylon fabric ribbons are welded. Such welds are thicker than the ribbon itself, and the printer head may produce an unsatisfactory character at the weld.

The print track of the present invention uses about 50% of the width of the film ribbon because of the ramp effect, whereas prior ribbon cartridges that do not provide a ramp effect were able to utilize a print track which used only about 20% of the film ribbon.

We claim:

1. A ramp ribbon cartridge adapted for ramp mounting of a ribbon in a printer device, comprising a cartridge housing having a bottom wall with upwardly depending sidewalls and a top cover, the cartridge housing having a first end and a second end, a ribbon, having top and bottom edges, stored in and extending from the cartridge housing and on which a printing head makes a track while printing, a drive wheel mounted in the housing for pulling the ribbon out of the housing such that the top edge of the portion of ribbon which extends out of the housing is parallel to the plane of the top cover of the housing, said drive wheel being rotatably mounted at a first end of the cartridge housing and being adapted to connect with a drive shaft in a printer device so as to form a printer drive shaft to cartridge drive wheel connection, the connection between the drive wheel of the cartridge and the drive shaft of the printer device being a loose fit so that the drive shaft drives the drive wheel without binding when the drive wheel is tilted on its axis, ramping means attached to the cartridge housing and extending downwardly from the housing and positioned away from the drive wheel end of the housing to elevate the second end of the housing and position the cartridge at a ramp angle to the horizontal, whereby when the ribbon cassette is placed in a printer having a drive shaft designed to engage a drive wheel of a flat ribbon cassette such that the flat ribbon cassette is in a horizontal position when used, the printing track of the ribbon is at a ramp angle to the top and bottom edges of the ribbon and is wider than if the ribbon were positioned in a horizontal attitude.

2. The ramp ribbon cartridge of claim 1, said ramp angle being such that the printing track does not leave the ribbon.

3. The ramp ribbon cartridge of claim 1, said ramping means comprising a resilient button mounted on the bottom of the housing near the second end.

4. A ramp ribbon cartridge adapted for ramp mounting of a ribbon in a printer device, comprising a cartridge housing having a first end and a second end, a ribbon, having top and bottom edges, stored in and extending from the cartridge housing and on which a printing head makes a track while printing, a drive wheel for pulling the ribbon out of the housing, said drive wheel being rotatably mounted at a first end of the cartridge housing and being adapted to connect with a drive shaft in a printer device, the connection between the drive wheel and the drive shaft of the printer device being a loose fit so that the drive shaft still drives the drive wheel without binding when the drive wheel is tilted on its axis, a ramping mechanism attached to the cartridge housing and extending downwardly from the housing and positioned away from the drive wheel end of the housing to elevate the second end of the housing and position the cartridge at a ramp angle to the horizontal, whereby the printing track of the ribbon is at a ramp angle to the top and bottom edges of the ribbon and is wider than if the ribbon were positioned in a horizontal attitude, said ramping means comprising a U-shaped riser clip with a base and a pair of legs extending therefrom, the bottom of the legs extending beneath the housing so as to elevate the second end of the housing when placed on a horizontal carrier in a printer, and base connecting means connecting the base of the clip to the housing.

5. The ramp ribbon cartridge of claim 4, said base connecting means being an ultrasonic weld between the clip base and the housing.

6. A ramp ribbon cartridge adapted for ramp mounting of a ribbon in a printer device, comprising a cartridge housing having a first end and a second end, a ribbon, having top and bottom edges, stored in and extending from the cartridge housing and on which a printing head makes a track while printing, a drive wheel for pulling the ribbon out of the housing, said drive wheel being rotatably mounted at a first end of the cartridge housing and being adapted to connect with a drive shaft in a printer device, the connection between the drive wheel and the drive shaft of the printer device being a loose fit so that the drive shaft still drives the drive wheel without binding when the drive wheel is tilted on its axis, a ramping mechanism attched to the cartridge housing and extending downwardly from the housing and positioned away from the drive wheel end of the housing to elevate the second end of the housing and position the cartridge at a ramp angle to the horizontal, whereby the printing track of the ribbon is at a ramp angle to the top and bottom edges of the ribbon and is wider than if the ribbon were positioned in a horizontal attitude, said ramp angle being such that the printing track does not leave the ribbon, said ramping mechanism comprising a U-shaped riser clip with a base and a pair of legs extending therefrom, the bottom of the legs extending beneath the housing so as to elevate the second end of the housing when placed on a horizontal carrier in a printer, and base connecting means connecting the base of the clip to the housing, said base connecting means being an ultrasonic weld between the clip base and the housing.

7. A ramp ribbon cartridge adapted for ramp mounting of a ribbon in a printer device, comprising a cartridge housing having a first end and a second end, a ribbon, having top and bottom edges, stored in and extending from the cartridge housing and on which a printing head makes a track while printing, a drive wheel for pulling the ribbon out of the housing, said drive wheel being rotatably mounted at a first end of the cartridge housing and being adapted to connect with a drive shaft in a printer device, the connection between the drive wheel and the drive shaft of the printer device being a loose fit so that the drive shaft still drives the drive wheel without binding when the drive wheel is tilted on its axis, a ramping mechanism attached to the cartridge housing and extending downwardly from the housing and positioned away from the drive wheel end of the housing to elevate the second end of the housing and position the cartridge at a ramp angle to the horizontal, whereby the printing track of the ribbon is at a ramp angle to the top and bottom edges of the ribbon and is wider than if the ribbon were positioned in a horizontal attitude, said ramping mechanism comprising a riser clip made of a synthetic plastic material that snaps into the cartridge housing, said riser clip being U-shaped and including a base with a pair of legs extending therefrom, each riser clip leg having a bend therein which snaps over a boss in the cartridge housing, each riser clip leg having bottom portions extending beneath the housing so that when the ribbon cartridge is placed on a horizontal carrier of a printing device, the cartridge and ribbon are placed in a ramp position.

* * * * *